US006883798B2

(12) United States Patent
Hsieh

(10) Patent No.: US 6,883,798 B2
(45) Date of Patent: Apr. 26, 2005

(54) SHEET FEEDER FOR MEDIA-FEED MECHANISM

(75) Inventor: Yen-Sung Hsieh, Taipei (CH)

(73) Assignee: Benq Corporation, Taoyuan (TW)

( * ) Notice: Subject to any disclaimer, the term of this patent is extended or adjusted under 35 U.S.C. 154(b) by 71 days.

(21) Appl. No.: 10/347,851

(22) Filed: Jan. 21, 2003

(65) Prior Publication Data

US 2003/0137094 A1 Jul. 24, 2003

(30) Foreign Application Priority Data

Jan. 23, 2002 (TW) ..... 91101065 A

(51) Int. Cl.[7] ..... B65H 5/06
(52) U.S. Cl. ..... 271/124; 271/274
(58) Field of Search ..... 271/121, 124, 271/18, 264, 272, 273, 274

(56) References Cited

U.S. PATENT DOCUMENTS

| | | | | | |
|---|---|---|---|---|---|
| 4,113,244 | A | * | 9/1978 | Ruenzi | 271/4.1 |
| 4,674,737 | A | * | 6/1987 | Murayoshi | 271/124 |
| 4,919,411 | A | * | 4/1990 | Ceelen | 271/35 |
| 5,261,652 | A | * | 11/1993 | Kubo | 271/119 |
| 5,277,417 | A | * | 1/1994 | Moritake et al. | 271/121 |
| 5,528,352 | A | * | 6/1996 | Ichinokawa et al. | 399/365 |
| 5,584,475 | A | * | 12/1996 | Asada et al. | 271/121 |
| 5,655,762 | A | * | 8/1997 | Yergenson | 271/121 |
| 5,718,424 | A | * | 2/1998 | Nakatani et al. | 271/121 |
| 5,890,707 | A | * | 4/1999 | Allibert et al. | 271/9.09 |
| 5,895,040 | A | * | 4/1999 | Oleksa et al. | 271/124 |
| 5,938,355 | A | * | 8/1999 | Suzuki | 400/624 |
| 5,971,390 | A | * | 10/1999 | Caspar et al. | 271/121 |
| 6,102,389 | A | * | 8/2000 | Sakurai et al. | 271/121 |
| 6,126,161 | A | * | 10/2000 | Kato | 271/121 |
| 6,158,733 | A | * | 12/2000 | Muraki | 271/127 |
| 6,290,224 | B1 | * | 9/2001 | Lin | 271/121 |
| 6,371,477 | B1 | * | 4/2002 | Lin | 271/121 |
| 6,398,205 | B1 | * | 6/2002 | Nakamura et al. | 271/18 |
| 6,491,295 | B2 | * | 12/2002 | Otsuka et al. | 271/118 |
| 6,502,816 | B2 | * | 1/2003 | Inoue et al. | 271/121 |
| 6,536,757 | B2 | * | 3/2003 | Chang | 271/16 |
| 6,543,761 | B2 | * | 4/2003 | Endo | 271/110 |
| 6,550,761 | B1 | * | 4/2003 | Chiang | 271/104 |
| 6,585,250 | B1 | * | 7/2003 | Hsiao | 271/121 |
| 2002/0070495 | A1 | * | 6/2002 | Takeuchi | 271/121 |
| 2003/0184005 | A1 | * | 10/2003 | Takito et al. | 271/121 |
| 2004/0017039 | A1 | * | 1/2004 | Asada et al. | 271/121 |
| 2004/0065992 | A1 | * | 4/2004 | Youn | 271/121 |

FOREIGN PATENT DOCUMENTS

| | | | | |
|---|---|---|---|---|
| EP | 409153 | * | 1/1991 | B65H/5/06 |
| JP | 58-59135 | * | 4/1983 | B65H/3/56 |
| JP | 1-104537 | * | 4/1989 | B65H/3/52 |
| JP | 1-172141 | * | 7/1989 | B65H/3/68 |
| JP | 2-132025 | * | 5/1990 | B65H/3/06 |
| JP | 6-144620 | * | 5/1994 | B65H/3/52 |

* cited by examiner

*Primary Examiner*—Donald P. Walsh
*Assistant Examiner*—Mark J. Beauchaine
(74) *Attorney, Agent, or Firm*—Quintero Law Office

(57) ABSTRACT

A sheet separator. The sheet separator includes a main body, a frictional member, and an elastic member. The main body is rotatable with a slot being longitudinally parallel to the moving direction of the medium. The frictional member is disposed in the slot and contacts the medium. When feeding, the medium exerts a first force on the main body through the frictional member. Moreover, the elastic member connects to the main body and exerts a second force thereon. According to the first force and the second force, the angle between the main body and the medium is adjusted.

18 Claims, 7 Drawing Sheets

SHEET FEEDER FOR MEDIA-FEED MECHANISM

BACKGROUND OF THE INVENTION

1. Field of the Invention

The present invention relates to a sheet separator, and particularly to a sheet separator with adjustable feed angle.

2. Description of the Related Art

The application of business machines in offices like printers, fax and copy machines have become more and more popular. Regarding business machines processing paper, media-feed mechanism has a great influence on efficiency. Therefore, it has become a new challenge to design a highly efficient media-feed mechanism to feed and separate media readily.

In general, with printers as an example, an automatic media-feed mechanism is utilized to feed the media. Before printing, users normally put the media in the media-feed mechanism. To print, media are moved out one by one through the media-feed mechanism.

Referring to FIG. 1A, an automatic media-feed mechanism has a bottom surface 101 to carry the media. The roller 150 is above the bottom surface 101 to drive the media. In particular, a sheet separator 103 and several smooth ribs 102 are disposed on the bottom surface 101. When the media are driven by the roller 105, the sheet separator 103 separates the media one by one and the ribs 102 keep the individual media moving out smoothly.

In FIG. 1B, a sheet separator 103 and several ribs 102 disposed on the bottom surface 101 of the automatic media-feed mechanism are parallel to the moving direction of the media. The ribs 102 sustain and keep the individual media sliding smoothly. In practice, the ribs 102 are plastic or metal with a smooth surface and have a low friction coefficient. Referring to FIG. 1C, the medium is driven by the roller 150 (not shown) in the direction A. The leading edge 107 of the medium 105 contacts the ribs 102 when moving.

As shown in FIG. 1D, when the medium 105 moved in direction A, the leading edge 107 of the medium 105 contacts the ribs 102 and the sheet separator 103. At the same time, the ribs 102 and the sheet separator 103 exert a frictional force on the medium 105 in direction B opposite to the direction A. In particular, the frictional force increases with the stiffness of the medium 105. Thus, the driving motor may be overloaded, missing steps, and the leading edge 107 of the medium 105 may be damaged by using excessively stiff media.

It is known that there are many categories of media made of different material of varying thickness (g/m2). Therefore, as shown in FIG. 1E, the sheet separating angle $\alpha$ is determined according to the corresponding available medium thickness. Only the media within a particular range of thickness are available when the sheet separating angle $\alpha$ is determined. For example, the sheet separator 103 may allow only media within stiffness of 70 g/m2 to 80 g/m2, but not for media with stiffness out of this range.

For this reason, the conventional sheet separator may cause multiple media feed at the same time and make the driving motor lose step by using excessively stiff media. Thus, the conventional sheet separator is only suitable for media in a particular range of thickness but cannot be widely used.

SUMMARY OF THE INVENTION

It is therefore an object of the present invention to provide a sheet separator with adjustable feed angle that can be widely used for media of varying thickness.

To achieve the above object, the present invention provides a sheet separator comprising a main body, a frictional member, and an elastic member. The main body is rotatable with a slot being longitudinally parallel to the moving direction of the medium. The frictional member is disposed in the slot and contacts the medium. When feeding, the medium exerts a first force on the main body through the frictional member. Moreover, the elastic member connects to the main body and exerts a second force thereon. According to the first force and the second force, the angle between the main body and the medium is adjusted.

A detailed description is given in the following embodiments with reference to the accompanying drawings.

BRIEF DESCRIPTION OF THE DRAWINGS

The aforementioned objects, features and advantages of the invention will become apparent by referring to the following detailed description of the preferred embodiment with reference to the accompanying drawings, wherein.

DETAILED DESCRIPTION OF THE INVENTION

Figure 1A:
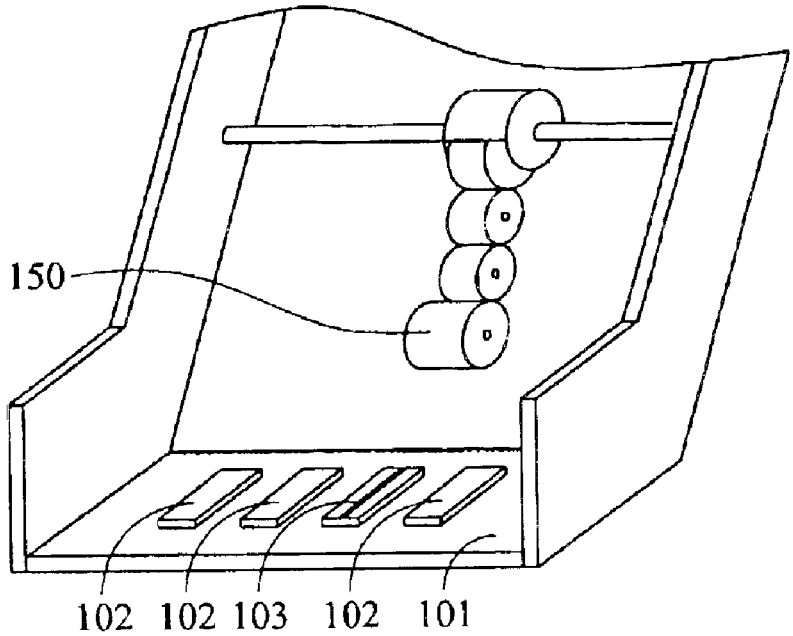
FIG. 1A ( PRIOR ART )
FIG. 1A (Prior Art) is a perspective diagram of a media-feed mechanism in a conventional business machine.
Figure 1B:
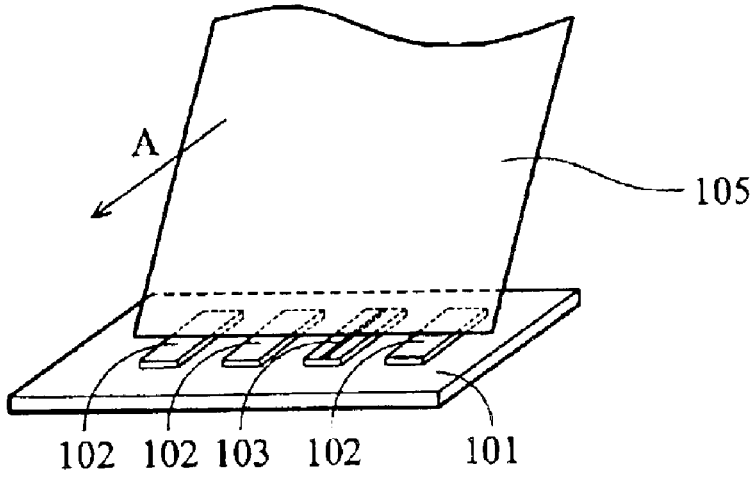
FIG. 1B ( PRIOR ART )
FIG. 1B (Prior Art) is a perspective diagram illustrating the medium moving along the ribs.
Figure 1C:
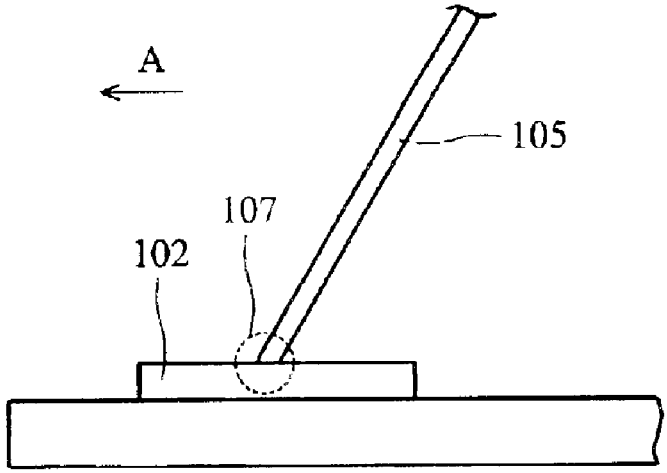
FIG. 1C ( PRIOR ART )
FIG. 1C (Prior Art) is a lateral view of FIG. 1B illustrating the medium moving along the ribs.
Figure 1D:
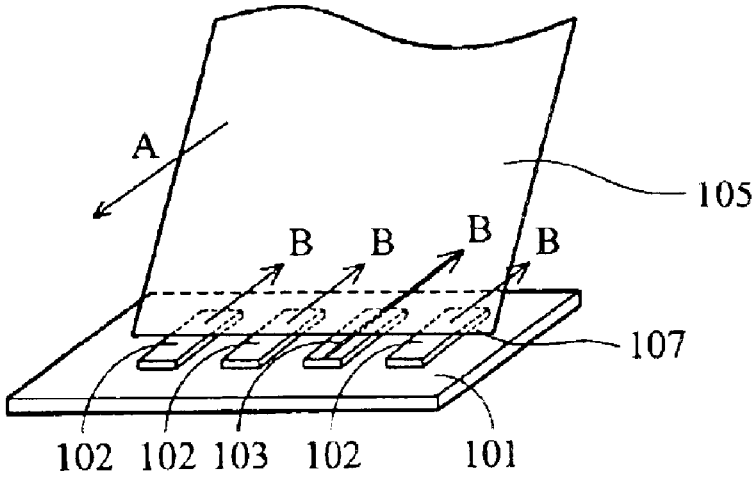
FIG. 1D ( PRIOR ART )
FIG. 1D (Prior Art) is a perspective diagram illustrating the medium moving along the ribs.
Figure 1E:
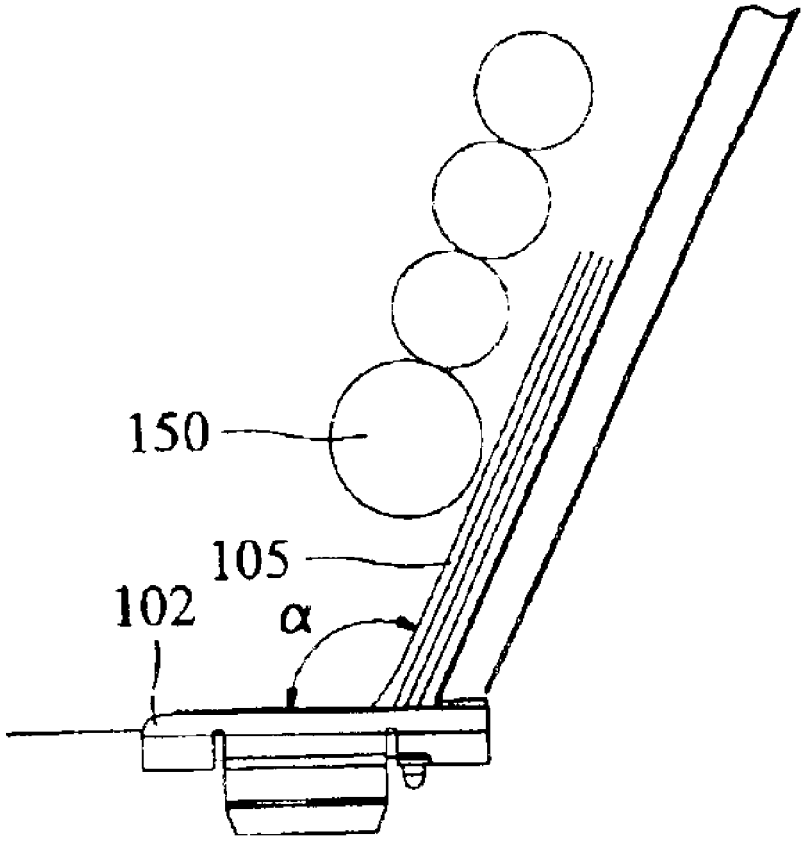
FIG. 1E ( PRIOR ART )
FIG. 1E (Prior Art) is a lateral view of FIG. 1D illustrating the medium moving along the ribs.
Figure 2A:
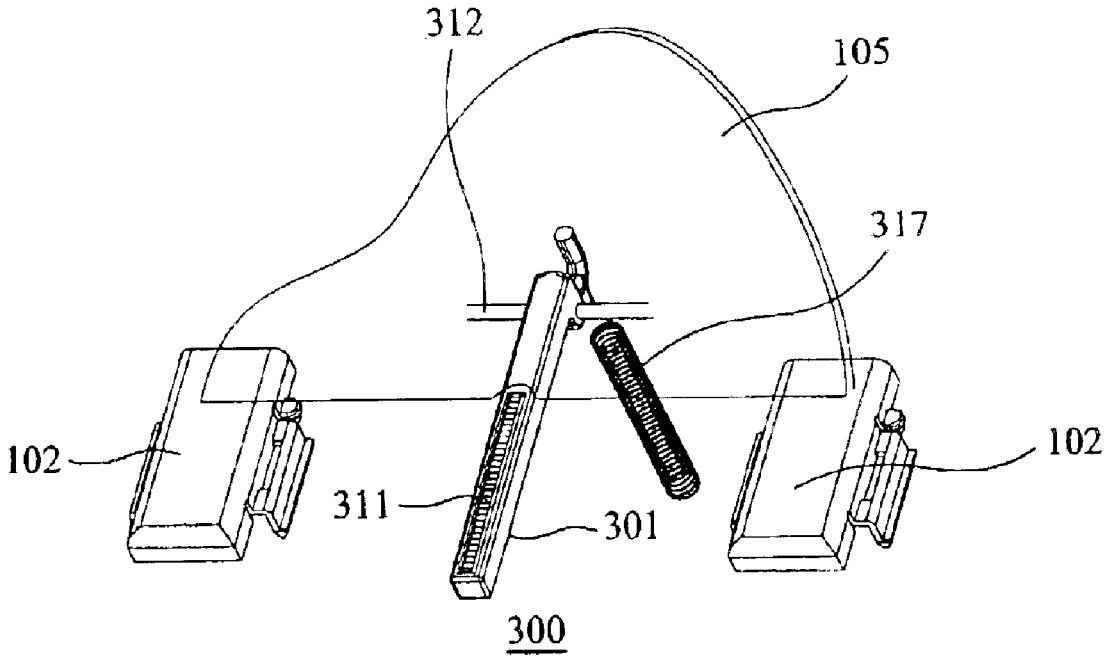
FIG. 2A is a perspective diagram of the medium separator in accordance with the first embodiment of the present invention.
Figure 2B:
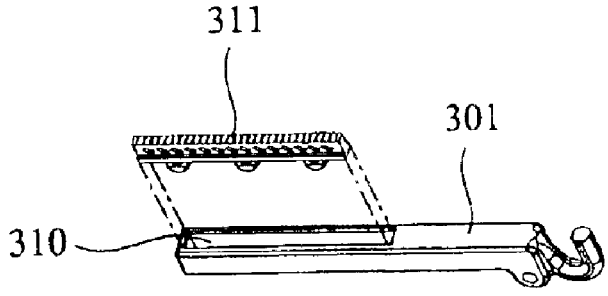
FIG. 2B is a exploded perspective diagram of FIG. 2A illustrating the sheet separator in accordance with the first embodiment of the present invention.
Figure 2C:
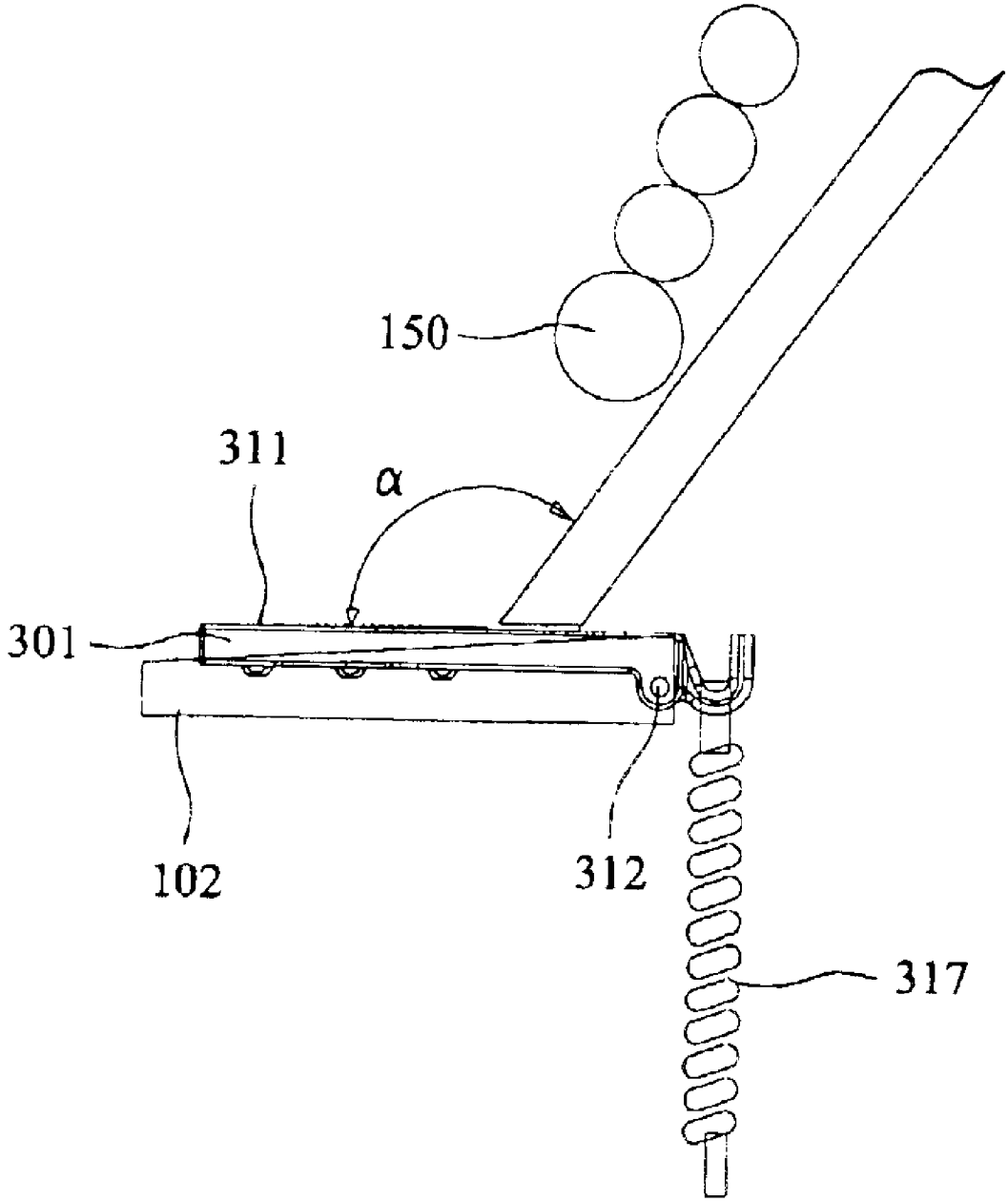
FIG. 2C is a lateral view of FIG. 2A illustrating the sheet separator in accordance with the first embodiment of the present invention.

As shown in FIGS. 2A, 2B and 2C, a frictional member 311 is disposed in the slot 310 of the sheet separator 300. Additionally, the frictional member 311 has a friction coefficient greater than the ribs 102 to generate a frictional damping force on the medium 105. In practice, the frictional member 311 can also be substituted by other wear-resistant material. Referring to FIG. 2A, an arm 301 is connected to a fixed axis 312 of the business machine in a rotatable manner. Moreover, one end of a spring 317 connects to the business machine, and the other end connects to the arm 301 to adjust the rotating angle of the arm 301. The arm 301 constitutes the main body of the sheet separator 300, and the frictional member 311 is disposed in the slot 310 with its top surface higher than the arm 311.

Figure 3A:
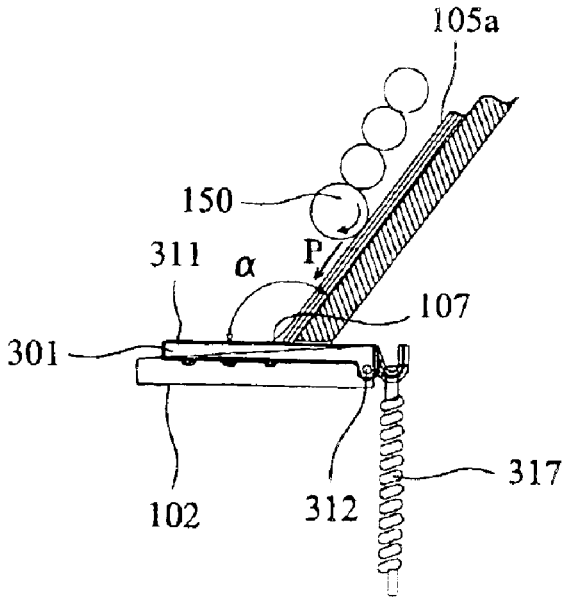
FIG. 3A is a lateral view of the sheet separator used with thinner media in accordance with the first embodiment of the present invention.

In FIG. 3A, media are placed on the top surface of the sheet separator 300 and the leading edge 107 of the top medium 105*a* contacts the frictional member 311. AT the same time, the medium 105*a* is driven by the roller 150 and the frictional member 311 generates a frictional damping force to keep all the other media in the cartridge to avoid multiple media feed.

Figure 3B:
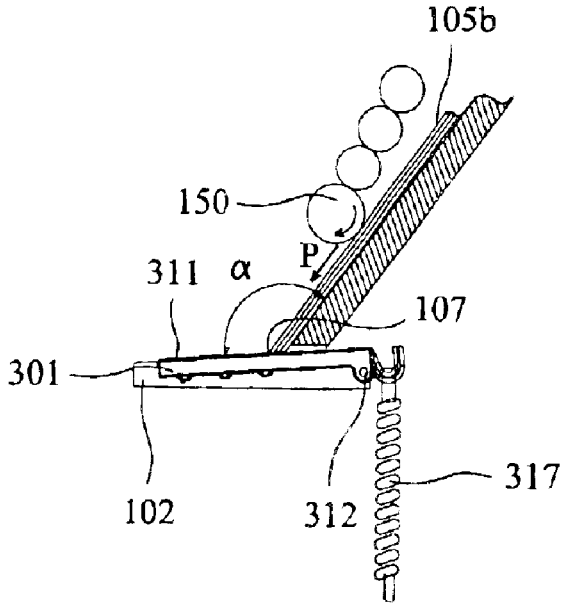
FIG. 3B is a lateral view of the sheet separator used with thicker media in accordance with the first embodiment of the present invention.

When the thinner medium 105*a* is driven by the force P from the roller 150, the top medium 105*a* buckles to absorb the opposing frictional damping force of the frictional member 311 so that the medium 105*a* can slide through the frictional member 311. As shown in FIG. 3B, however, when thicker media are applied, the sheet separating angle α between the medium 105*b* and the arm 301 becomes larger by the force P from roller 150 so that the frictional force generated by the frictional member 311 decreases and the thicker medium 105*b* can slide out easily.

Figure 4:
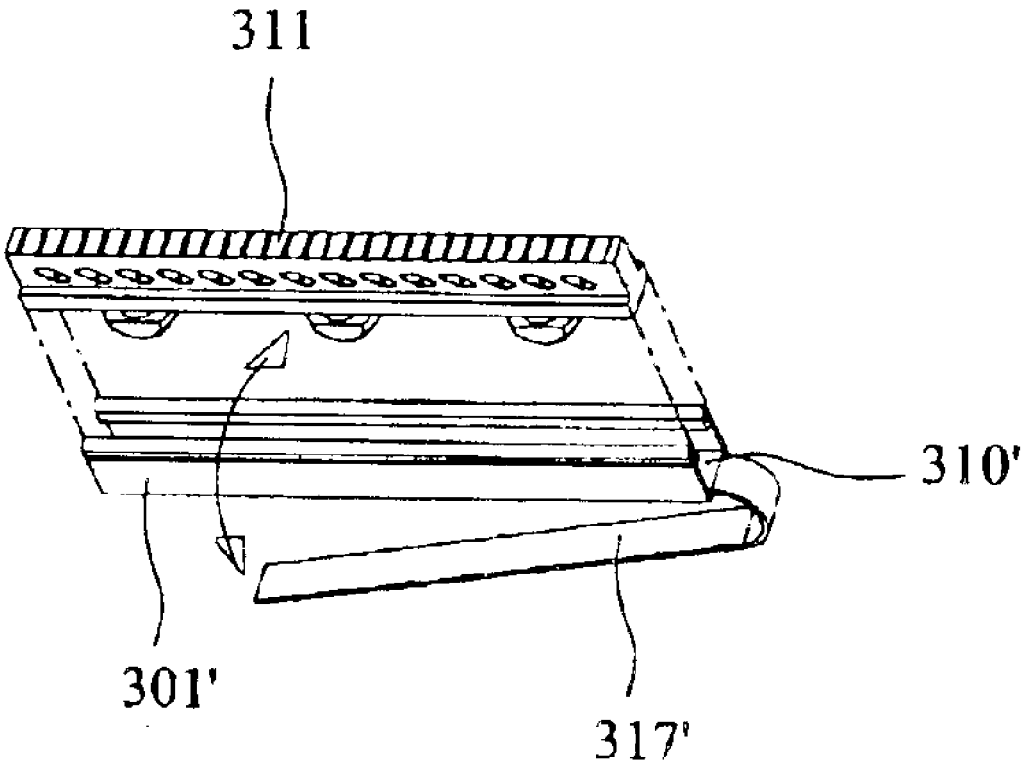
FIG. 4 is a perspective diagram of the sheet separator in accordance with the second embodiment of the present invention.

FIG. 4 is a perspective diagram of the sheet separator in accordance with the second embodiment of the present invention. As shown in FIG. 4, an arm 301' extends with a flexible sheet 317' substituted for the spring 317 in the first embodiment, and a frictional member 311 is disposed in the slot 310' of the arm 301'. Moreover, the flexible sheet 317' contacts the base of the business machine so that the sheet separating angle α is adjustable. Thus, the sheet separator in the second embodiment has the same functionality as the first embodiment.

The present invention provides a sheet separator widely suitable for different media of varying thickness. Moreover, the sheet separator in the present invention can reduce the incidence of paper jam or multiple media feed with better performance and stability than before.

When the invention has been described by way of example and in terms of the preferred embodiments, it is to be understood that the invention is not limited to the disclosed embodiments. To the contrary, it is intended to cover various modifications and similar arrangements (as would be apparent to those skilled in the art). Therefore, the scope of the appended claims should be accorded the broadest interpretation so as to encompass all such modifications and similar arrangements.

What is claimed is:

1. A sheet separator for a media-feed mechanism of an apparatus feeding at least one medium, comprising:

an arm connected to the apparatus, comprising a slot;

a frictional member disposed in the slot and contacting the medium, wherein the medium exerts a first force on the arm via the frictional member when feeding; and an elastic member connected to the arm, exerting a second force on the arm, wherein an angle between the arm and the medium is adjusted according to the first force and the second force.

2. The sheet separator as claimed in claim 1, wherein the arm is rotatably connected to the apparatus and the elastic member also connects to the apparatus.

3. The sheet separator as claimed in claim 1, wherein the elastic member is a spring.

4. The sheet separator as claimed in claim 1, wherein the elastic member is a flexible sheet.

5. The sheet separator as claimed in claim 1, wherein the frictional surface is made of rubber.

6. A sheet separator for a media-feed mechanism feeding at least one medium of an apparatus, comprising:

a main body, having a slot being longitudinally parallel to a moving direction of the medium;

a frictional member disposed in the slot and contacting the medium, wherein the medium exerts a first force on the main body via the frictional member when feeding; and an elastic member connected to the main body, exerting a second force on the main body, wherein an angle between the main body and the medium is adjusted according to the first force and the second force.

7. The sheet separator as claimed in claim 6, wherein the main body further has an arm rotatably connected to the apparatus and the elastic member also connects to the apparatus.

8. The sheet separator as claimed in claim 6, wherein the frictional member protrudes from the slot.

9. The sheet separator as claimed in claim 6, wherein the elastic member is a spring.

10. The sheet separator as claimed in claim 6, wherein the elastic member is a flexible sheet.

11. The sheet separator as claimed in claim 6, wherein the frictional member is made of rubber.

12. A media-feed mechanism of an apparatus feeding at least one medium, comprising:

a bottom surface;

a sheet separator disposed on the bottom surface, comprising:

an arm connected to the apparatus, comprising a slot;

a frictional member disposed in the slot, comprising a frictional surface contacting the medium, wherein the medium exerts a first force on the arm via the frictional surface when feeding;

an elastic member connected to the arm, exerting a second force on the arm; and at least one rib disposed on the bottom surface to sustain a leading edge of the medium, wherein an angle between the arm and the medium is adjusted according to the first force and the second force.

13. The media-feed mechanism as claimed in claim 12, wherein the arm is rotatably connected to the apparatus and the elastic member also connects to the apparatus.

14. The media-feed mechanism as claimed in claim 12, wherein the elastic member is a spring.

15. The media-feed mechanism as claimed in claim 12, wherein the elastic member is a flexible sheet.

16. The media-feed mechanism as claimed in claim 12, wherein the frictional member protrudes from the slot.

17. The media-feed mechanism as claimed in claim 12, wherein the frictional surface is made of rubber.

18. The media-feed mechanism as claimed in claim 12, wherein a friction coefficient of the frictional surface is greater than a friction coefficient of the rib.

* * * * *